US006693627B1

(12) United States Patent
Lee et al.

(10) Patent No.: US 6,693,627 B1
(45) Date of Patent: Feb. 17, 2004

(54) APPARATUS AND METHOD FOR AUTOMATICALLY DISPLAYING INFORMATION

(75) Inventors: Myun Woo Lee, 103-20, Sungsan-dong, Mapo-gu, Seoul 121-250 (KR); Chang Kyu Cho, Kyunggi-do (KR); Jae Young Kim, Seoul (KR); Tae Sin Ha, Seoul (KR)

(73) Assignee: Myun Woo Lee (KR)

( * ) Notice: Subject to any disclaimer, the term of this patent is extended or adjusted under 35 U.S.C. 154(b) by 0 days.

(21) Appl. No.: 09/600,160

(22) PCT Filed: Feb. 1, 1999

(86) PCT No.: PCT/KR99/00048

§ 371 (c)(1),
(2), (4) Date: Aug. 1, 2000

(87) PCT Pub. No.: WO99/39252

PCT Pub. Date: Aug. 5, 1999

(30) Foreign Application Priority Data

Feb. 2, 1998 (KR) ..... 98-2838

(51) Int. Cl.[7] ..... G09G 5/00

(52) U.S. Cl. ..... 345/204; 345/87; 368/10; 368/23

(58) Field of Search ..... 345/204, 205, 345/87; 368/10, 21, 23

(56) References Cited

U.S. PATENT DOCUMENTS 4,316,272 A * 2/1982 Naito ..... 368/21
4,367,051 A * 1/1983 Inoue ..... 368/111
4,412,304 A * 10/1983 Yamakita ..... 364/900
4,490,711 A * 12/1984 Johnston ..... 368/10
4,588,303 A * 5/1986 Wirtschafter et al. ..... 368/10
4,715,385 A * 12/1987 Cudahy et al. ..... 368/10
5,097,429 A * 3/1992 Wood et al. ..... 368/10
5,691,932 A 11/1997 Reiner et al.
5,795,161 A * 8/1998 Vogel ..... 434/350
6,018,289 A * 1/2000 Sekura et al. ..... 340/309.4
6,130,860 A * 10/2000 Suzuki ..... 368/10
6,600,696 B1 * 7/2003 Lynn ..... 368/23

FOREIGN PATENT DOCUMENTS

GB 2193015 1/1988
JP 1-250230 10/1989

* cited by examiner

*Primary Examiner*—Richard Hjerpe
*Assistant Examiner*—Kimnhung Nguyen
(74) *Attorney, Agent, or Firm*—Rothwell, Figg, Ernst & Manbeck

(57) ABSTRACT

The present invention provides an apparatus and method which contains a particular date preset by a user and several groups of particular information, each group relating to a pre-specified date difference between the preset date and current date, and automatically displays a group of information corresponding to current date difference. The apparatus according to the present invention comprises a non-volatile memory for storing information corresponding to date differences, a timing unit for tracking current time and date, a control unit for calculating the date difference between the preset date and current date and reading out information depending upon the date difference from the memory, a ROM storing an execution program, a font ROM storing display fonts, a LCD control unit, a LCD panel, an audio signal generation unit, and a beeper.

10 Claims, 2 Drawing Sheets

APPARATUS AND METHOD FOR AUTOMATICALLY DISPLAYING INFORMATION

TECHNICAL FIELD

The present invention relates generally to an apparatus and method for automatically displaying information corresponding to date difference between a particular date and current date, and more particularly, but not by way of limitation, to an apparatus which contains several groups of particular information, each group relating to one of pre-specified date differences, and automatically displays a group of information corresponding to date difference between a preset particular date and current date and the method employed therein.

BACKGROUND ART

Even in the modern society wherein people lead hectic lives, people have some particularly important days to remember. In some cases, it is necessary to do activities related to particular days, the activities depending upon how many days are left toward the particular days or passed since the particular days.

Pregnancy or bring up babies may be one of the most important things in life. In the case of pregnancy, the expected date of childbirth is a particular basic date and so is the date of birth in the case of nursing infants. For example, it is extremely important for a pregnant woman to regularly check unborn baby's condition on the basis of the expected date of childbirth. Likewise, the mother of an infant should keep in mind what sort of preventive inoculation is needed for her baby on the basis of the baby's date of birth.

Most hospitals for pregnant women or infants provide special booklets which contain useful information concerned with delivery or necessary for nursing infants so that the readers can easily notice what to prepare or when to do some particular tasks. It is not a simple matter, however, that pregnant women or mothers of infants find time to consult such booklets regularly, since having or nursing babies requires much time and efforts in itself. And, such booklets might miss some particular information since it is almost impossible to record every necessary detailed information relating to delivery or bringing up infants on such booklets.

Moreover, it is troublesome that uncomfortable pregnant women and mothers busy nursing babies calculate days remaining till the expected date of childbirth or days passed since the date of birth and consult booklets for particular information corresponding to the date difference. From time to time, some inevitable tasks such as preventive inoculation for babies or medical check-up of pregnant women are missed, which is very embarrassing and might cause serious problems.

DISCLOSURE OF INVENTION

The present invention has been developed to solve the foregoing problems. It is a primary object of the present invention to provide an apparatus and method for automatically displaying information depending on date difference between a particular date and current date so that the user can be easily notice necessary information on the basis of the date difference.

The apparatus for automatically displaying information comprises a means for tracking the passage of time; a means for calculating date difference between the date obtained from said time tracking means and a preset date; a storing means having information corresponding to date difference; a means for checking whether the calculated date difference coincides with a particular number; a means for reading out information corresponding to the calculated date difference from said storing means, if confirmed by said checking means; and a means for displaying the information read out.

The method for automatically displaying information, comprising the steps of: setting a particular date inputted; calculating date difference between said particular date and current date; checking whether the calculated date difference coincides with one of pre-specified numbers; and displaying information corresponding to the calculated date difference based on the checking result.

The operation of the apparatus and method for automatically displaying information according to the present invention is as follows. The passage of time is tracked by the timing means and the date difference between a particular date set by a user and current date is calculated by the calculating means. The calculated date difference is tested if it coincides with one of many numbers pre-specified at least one of the plurality of date differences being other than zero internally and if so, the reading means reads out information corresponding to the date difference from the storing means. Consequently the relevant information is displayed by the displaying means.

The apparatus and method for automatically displaying information according to the present invention help people who need a good deal of information but have difficulty obtaining it, such as uncomfortable pregnant women or working women with babies to bring up, obtain necessary information easily when it is necessary, thereby preventing them from missing some important activities or getting in trouble by missing such activities.

BRIEF DESCRIPTION OF DRAWINGS

The accompanying drawings, which are included to provide a further understanding of the invention, illustrate a preferred embodiment of this invention, and together with the description serve to explain the principles of the present invention.

In the drawings.

MODES FOR CARRYING OUT THE INVENTION

The preferred embodiment of the present invention will be described in detail referring to the accompanying drawings.

Figure 1:
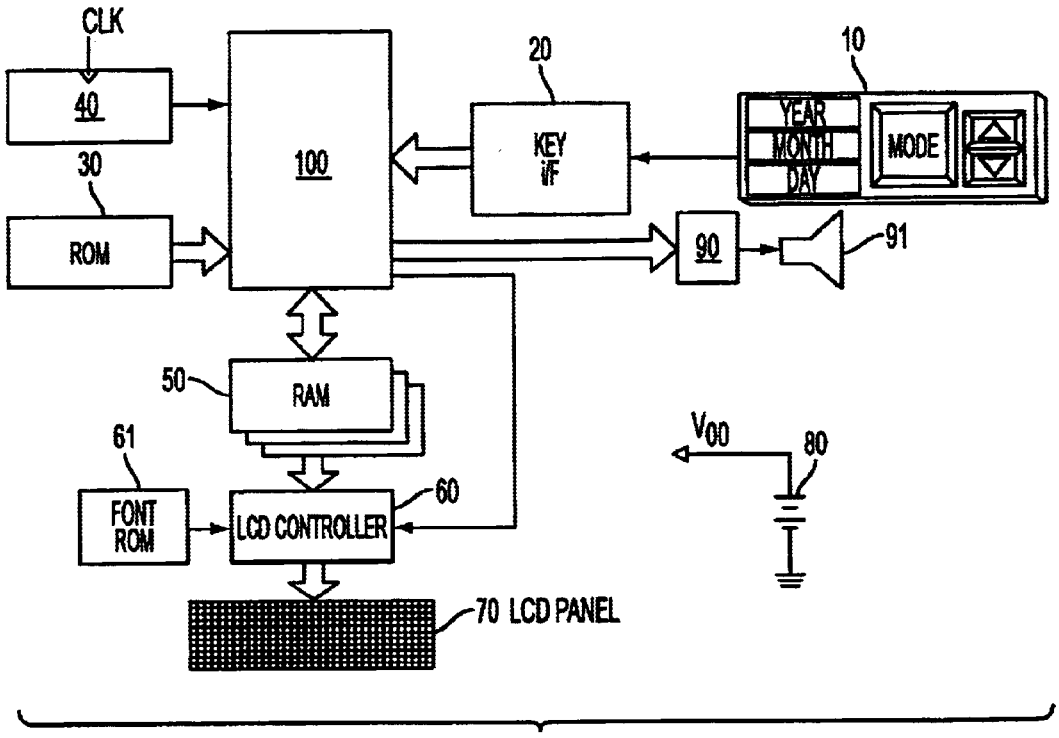
FIG. 1 is a schematic diagram of an apparatus for automatically displaying information according to the present invention.
Figure 2:
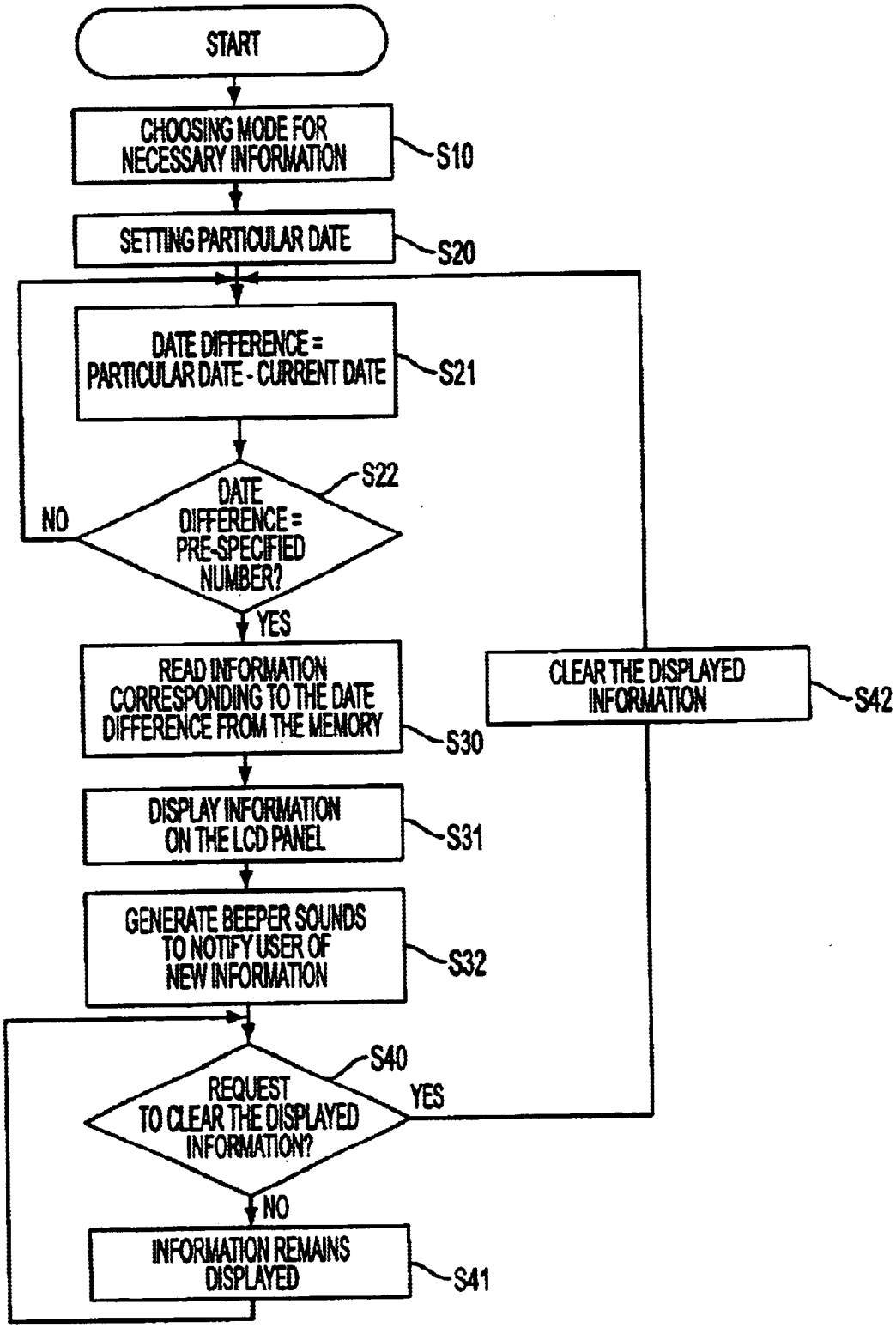
FIG. 2 is a flow chart of the method for automatically displaying information according to the present invention.

FIG. 1 is a block diagram of an apparatus for automatically displaying information as an embodiment of the present invention and FIG. 2 is a flow chart of the method for automatically displaying information according to the present invention.

The apparatus in FIG. 1, which may be applied to devices with timing function such as wrist watches or portable table clocks, comprises a non-volatile memory 50 for storing information corresponding to many values of date differences pre-specified internally, a key input unit 10 for choosing a specific mode using a mode key and movement keys and entering a basic date, a key interface unit 20 for scanning the key input unit 10 to receive a user's instructions, a timing unit 40 for tracking current time and date, a control unit 100 for calculating date difference between the basic date and current date and reading out information depending upon the date difference from the memory 50, a ROM 30 for storing a program to be executed by the control unit 100, a font ROM 61 for storing display fonts, a LCD control unit 60 for converting the read date into LCD display signals using the font obtained from the font ROM 61, a LCD panel 70 for displaying the information using the font, an audio signal generation unit 90 for generating audio signals, a beeper 91 for converting audio signals into audible sounds, and a battery 80 for supplying power to every system component.

Powered by the battery 80, the apparatus for automatically displaying information performs operations by executing the program stored in the ROM 30. A user chooses a mode using the mode key in the key input unit 10 before presetting a particular date for receiving information depending upon date difference between the current date and the particular date (S10). The user-selectable mode may be concerned with one of information on pregnant women, information on unborn babies, or information on nursing infants.

Selecting the mode relevant to unborn babies, the user sets a particular date, in this case the expected date of childbirth, by incrementing or decrementing an initially displayed date using up/down keys in the key input unit 10 (S20). Scanning the key input unit 10, the key interface unit 20 checks whether a key is pressed and if so, it transfers data concerned with the pressed key to the control unit 100 executing the program stored in the ROM 30.

Depending upon the received key input, the control unit 100 increments or decrements one of year, month, or date field displayed on the LCD panel 70. Provided that the mode key is pressed while entering the date, the control unit 100 sets the currently displayed date as a particular basic date and calculates the date difference by executing the program stored in the ROM 30 using the current date provided by the timing unit 40 (S21). If the selected mode is concerned with information on unborn babies, the date difference can be expressed as date difference=particular date (the expected date of childbirth)−current date.

On the other hand, if the mode chosen in step S10 is related to information required for nursing infants, the equation for calculating date difference is expressed as date difference=current date−particular date (the date of birth).

The control unit 100 keeps comparing the calculated date difference with pre-specified date differences (S22). The values of pre-specified date differences may be stored in the memory 50 or be written in the program codes stored in the ROM 30. Provided the calculated date difference coincides with one of the pre-specified date differences, the control unit 100 reads information related to the date difference from the memory 50 (S30).

The read information is transferred to the LCD control unit 60, which converts the information to a LCD display signal using the font data or graphic data stored in the font ROM 61. Finally, the information can be displayed on the LCD panel 70 (S31).

Along with displaying the information on the LCD panel 70, the control unit 100 issues a control command to the audio signal generation unit 90 to notify display of the new data. In response to the control command, the beeper 91 makes intermittent sounds, thereby the user being able to notice the display of new information data (S32).

If the user requests to clear the information displayed on the LCD panel 70 using the key input unit 10 (S40), the control unit 100 clears the information displayed on the LCD panel 70 through the LCD control unit 60 (S42) and repeats the aforementioned procedure. Unless the request to clear the information displayed on the LCD panel has been received, the information on the LCD panel remains displayed (S41).

What is claimed is:

1. An apparatus for automatically displaying information, comprising:

a means for tracking the passage of time to obtain a current date;

a means for calculating a date difference between the current date obtained from said time tracking means and a user set date;

a storing means having a plurality of pre-stored pieces of information corresponding to a plurality of date differences from said user set date, each date difference being related to at least one of the plurality of pre-stored pieces of information, at least one of the plurality of date differences being other than zero;

a means for checking whether the calculated date difference coincides with one of the plurality of date differences;

a means for reading out information corresponding to the calculated date difference from said storing means, if confirmed by said checking means; and a means for displaying the information read out.

2. An apparatus according to claim 1, wherein said information is information concerned with nursing infants depending upon increment of date difference.

3. An apparatus according to claim 1, wherein said information is information concerned with pregnant women depending upon decrement of date difference.

4. An apparatus according to claim 1, wherein said information is information concerned with unborn babies depending upon decrement of date difference.

5. A method for automatically displaying information, comprising the steps of:

(a) selecting a particular date;

(b) calculating a date difference between said particular date and a current date;

(c) checking whether the calculated date difference coincides with one of a plurality of pre-specified numbers, at least one of the pre-specified numbers being other than zero, said plurality of pre-specified numbers corresponding to at least one of a plurality of pre-stored pieces of information;

(d) displaying a piece of information from said plurality of pieces of information corresponding to the calculated date difference based on the checking result.

6. A method according to claim 5, wherein said date difference calculated in said step (b) decreases as date passes.

7. A method according to claim 5, wherein said date difference calculated in said step (b) increases as date passes.

8. A method according to claim 5, wherein information displayed in said step (d) is of the graphic form.

9. A method according to claim 5, wherein information displayed in said step (d) has one of several predefined formats depending upon a user's selection.

10. A method according to claim 5, wherein said step (d) further comprises a step for generating audio sounds.

* * * * *